United States Patent [19]

Schneider

[11] Patent Number: 4,870,913

[45] Date of Patent: Oct. 3, 1989

[54] GRATE COOLER FOR COOLING HOT BULK MATERIAL

[75] Inventor: Richard Schneider, Wermelskirchen, Fed. Rep. of Germany

[73] Assignee: Klöckner-Humboldt Deutz Aktiengesellschaft, Fed. Rep. of Germany

[21] Appl. No.: 258,184

[22] Filed: Oct. 7, 1988

[30] Foreign Application Priority Data

Oct. 8, 1987 [DE] Fed. Rep. of Germany ..... 3734043

[51] Int. Cl.[4] ..... F23H 3/00

[52] U.S. Cl. ..... 110/299; 110/281; 110/291; 126/163 R

[58] Field of Search ..... 110/290, 291, 298, 299, 110/300, 281; 198/773; 126/163 R

[56] References Cited

U.S. PATENT DOCUMENTS 4,463,688 8/1984 Andreoli ..... 110/298

4,479,441 10/1984 Somodi ..... 110/298 X 4,563,959 1/1986 Fujiwara ..... 110/299 X

FOREIGN PATENT DOCUMENTS

DE2604611-C2 2/1982 Fed. Rep. of Germany .

*Primary Examiner*—Edward G. Favors

*Attorney, Agent, or Firm*—Hill, Van Santen, Steadman & Simpson

[57] ABSTRACT

Grate plate carriers are formed box-shaped having a planar cover plate that, extending in the product conveying direction, joins to the following cover plate and is provided with openings that are covered at a slight distance therefrom by the grate plate lying on top thereof and formed flat, so that slot-shaped air passage openings remain between the cover plate and the grate plate, said slot-shaped air passage openings discharging into correspondingly formed air passage slots of the grate plate; and in that every box-shaped grate plate carrier is independently connected to a cooling air delivery conduit.

10 Claims, 1 Drawing Sheet

GRATE COOLER FOR COOLING HOT BULK MATERIAL

BACKGROUND OF THE INVENTION

The invention relates to a grate cooler for cooling hot bulk material with cooling air which comprises grate plates that are angled off at their front end and are detachably arranged on grate plate carriers.

German Patent No. 26 04 611 discloses a grate cooler of the above type wherein the grate plates are seated on carrier beams and are clamped thereto so that they can be easily detached from the carrier beam as needed and can be replaced with new grate plates. The grate of this grate cooler comprises a plurality of stationary and movable grate plate carrier beams on which a plurality of grate plates provided with cooling air bores are secured. The delivery of cooling air to the individual grate plates is thus effected emanating from a common cooling air collecting space. During operation of this grate cooler, parts of the solids to be cooled can drop down through the bores in the grate plates into the cooling air collecting space from where they must be outwardly transported and carried away with the assistance of special means. Given different material distributions as frequently occur in the product discharge region of a rotary tubular kiln with a slide-type grate cooler, the streams of cooling air can flow through the product bed in an uncontrolled fashion. This occurs both in the flow direction of the material as well as transversely relative to the conveying direction of the cooled product, and additional, different flow-through resistances that deteriorate the cooling effect occur as a consequence of the separation of coarse product and fine product that appear in the product discharge region of the rotary tubular kiln.

An object of the invention is to significantly improve the previously known grate cooler, particularly relative to its structural design and cooling effect.

FEATURES OF THE INVENTION

The objects and advantages of the present invention are achieved in that the grate plate carriers are constructed box-shaped having a planar cover plate that extends in the product discharge direction. The plate joins to the following carrier plate and is provided with openings that are covered with slight spacing adjacent the grate plate that rests on top and is flat, so that slot-shaped air passage openings remain between the cover plate and the grate plate, these openings discharging into corresponding air passage slots of the grate plate. Each box-shaped grate plate carrier is separately connected to a cooling air delivery conduit.

The box-shaped grate plate carrier of the invention is separately connected to a cooling air delivery conduit, and every grate plate can be advantageously individually charged with the quantity of cooling air required for cooling the hot bulk material on the grate plate and can be optimally supplied with cooling air. This leads to a considerable improvement of the cooling effect of the bulk material situated on the cooler grate. Further, the arrangement of the slot-shaped air passage openings situated between the cover plate and the grate plate in combination with the air passage slots in the grate plate prevents solids from falling down through the slot-shaped air passage openings situated between the cover plate and the grate plate as well as through the openings in the carrier plate even with outage of the delivery of cooling air. The cooling air delivery conduits of the individual grate plate carriers are thereby very advantageously combined to form a system outside of the grate cooler housing and are provided with throttle members, so that the quantity of cooling air required during operation of the grate cooler can be set from the outside.

For the purpose of optimizing the quantity of cooling air to be delivered to the bulk material, recesses are provided in the cover plate of the grate plate carrier in the region of the slot-shaped air passage openings in a further development of the invention and appropriate elements are inserted into these recesses. The quantity of cooling air passing through can be influenced with the assistance of these elements by enlarging or reducing the size of the slot-shaped air passage openings.

In a further development of the invention, the slot-shaped openings in the grate plate are expanded funnel-like in an upward direction. In this way, the grate plate is protected against premature wear in the region of the slot-shaped openings.

Other features and advantages will become more apparent with the teaching of the principles of the invention in connection with the disclosure of the preferred embodiment thereof in the specification, claims and drawings, in which:

DESCRIPTION OF THE PREFERRED EMBODIMENT

Figures 1, 2, 3:
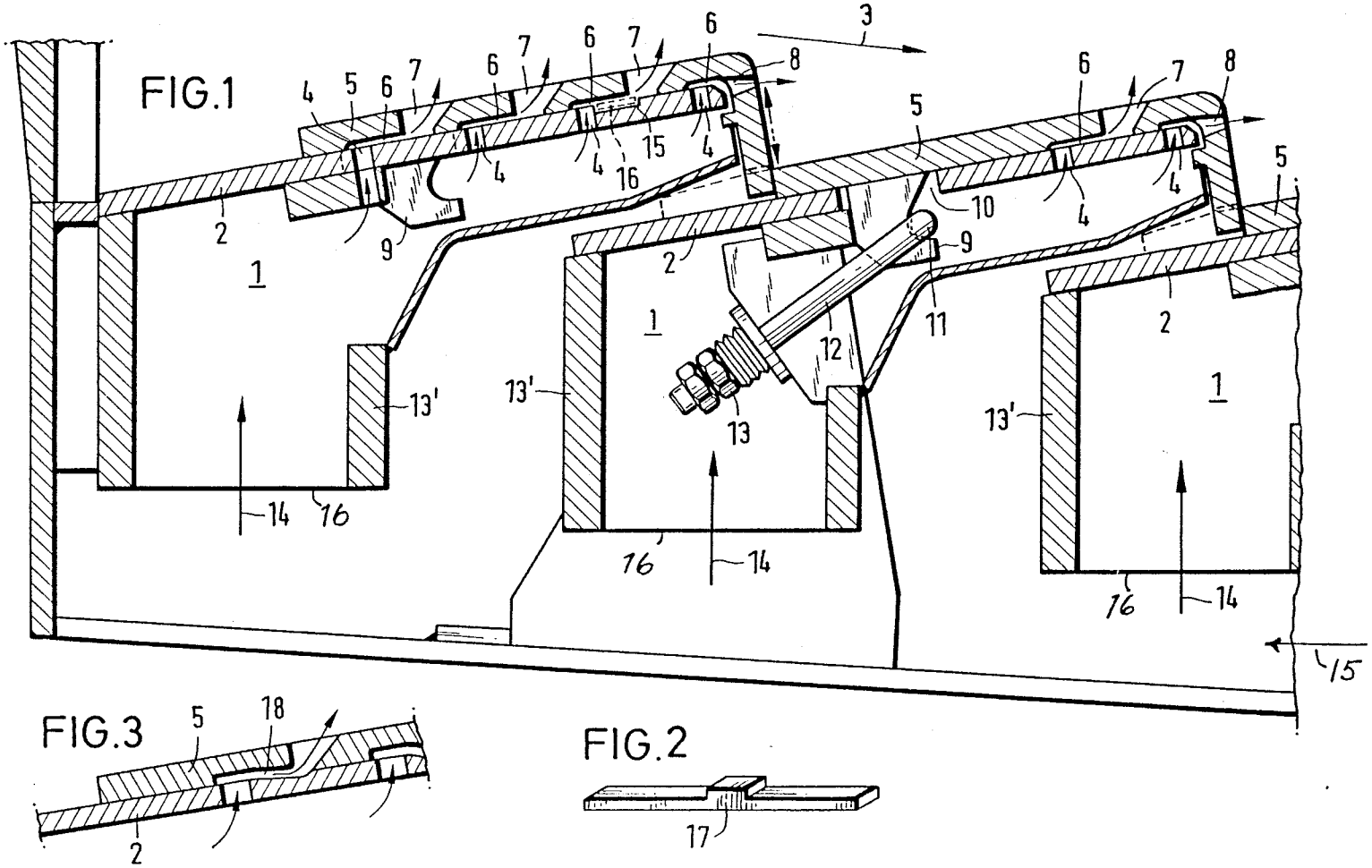
FIG. 1 illustrates a grate cooler of the invention shown principally in a vertical section.
FIG. 2 illustrates an insert element in the cover plate of the grate plate carrier shown in perspective.
FIG. 3 illustrates a slot-shaped passage opening of the invention arranged between the grate plate and grate plate carrier, shown in a partial longitudinal section.

As FIG. 1 shows, the grate cooler of the invention comprises a plurality of grate plate carriers 1 arranged following one another, these being box-shaped and comprising a planar cover plate 2 at the top that extends in the product conveying direction 3 and covers the following carrier plate in the form of a roof tile. The cover plates 2 are provided with openings 4 that are covered at a slight distance therefrom by the grate plate 5 that is angled off at the front, lies on the top thereof and is likewise formed flat, being covered such that slot-shaped passage openings 6 remain between the cover plate 2 and the grate plate 5. The slot-shaped air passage openings 6 in turn discharge into correspondingly constructed, slot-shaped openings 7 in the grate plate 5.

The slot-shaped openings 7 in the grate plate 5 are advantageously constructed expanded funnel-like in an upward direction, whereby the downstream wall of the slot-shaped opening 7 has a pronounced slope proceeding in product conveying direction 3. In this way, the grate plates 5 are very advantageously protected against premature wear in the region of the slot-shaped openings 7. Acting in product conveying direction, the cooling air is blown in from below into the bulk material to be cooled.

At their angled substantially vertical face end or nose, the grate plates 5 are provided with nozzle-shaped air exit openings 8 that are directed in the product conveying direction 3. In addition to providing a good cooling of the hot bulk material, these nozzles 8 which can also be constructed slot-shaped also effectively promote the product conveying on the grate and prevent the formation of cakings in the step-shaped transition region between the grate plates 5. The grate plates 5, moreover, are equipped with projections 9 that extend through corresponding openings 10 in the cover plate 2 from above and are rigidly clamped to the cover plate 2. For clamping, there is provided a clamping mechanism comprising a bolt 11, tie rod 12 and a spring behind a nut 13.

Every box-shaped grate plate carrier 1 is independently connected to a cooling air delivery conduit 13' that is provided with an air quantity control means, for example, a throttle member arranged outside of the grate cooler housing, is provided and not shown in detail in the drawing. Air is supplied at 15 with the throttle members located at 16. In this way, every grate plate of the grate cooler can be advantageously set to a defined quantity of cooling air during operation and can be supplied with an optimum quantity of cooling air that is completely independent of that of the other grate plates. Moreover, this mutually separate cooling air delivery to the individual grate plates 5 also enables a precise control of the air distribution and charging of the individual grate plates with cooling air overall in the arrow direction 14 of the grate cooler. The arrangement of the grate plate carriers 1 which extend in the product conveying direction and respectively cover the following carrier plate in the form of a roof tile advantageously coacts with the drive and the thrust motion of individual grate plates or rows of grate plates as well as the drive of the grate plate carriers at different speeds, so that the conveying rate of the material to be cooled can be advantageously influenced as a result thereof. To this end, as indicated with broken lines in FIG. 1, the following grate plate 5 is lengthened toward the back, so that the preceding grate plate 5 can slide thereon in the product conveying direction 3.

In order to be able to influence the throughput rate and/or quantity of the cooling air flowing through the slot-shaped openings 7, recesses 15 are provided in the cover plate 2 of the grate plate carrier 1 in the region of the slot-shaped air passage openings 6 and variable-thickness elements 16 that are correspondingly constructed are capable of being inserted into these recesses 15. The flow-through resistance the grate plate 5 offers the cooling air can be advantageously optimally set to the respective uses with the assistance of the elements 16. A variable modification of the air passage openings 6 can also be advantageously achieved on the basis of a raiseable and lowerable arrangement of the grate plates 5 on the grate plate carriers 1.

In order to be able to fix and hold the grate plate 5 on the cover plate 2 by a defined, upwardly lifted amount, it is expedient to use a plate-shaped element 17 that, as shown by way of example in FIG. 2 which is provided with a correspondingly elevated projection in the center.

In order to reliably prevent solids from falling through the slot-shaped air passage openings 6 and from there through the openings 4 into the grate plate carrier 1, even with interruption of the delivery of cooling air to the grate plates, the slot-shaped opening 18 in the cover plate 2 can also slope downwardly, as shown in FIG. 3. Moreover, the grate plates 5 are arranged such on the cover plates 2 of the grate plate carriers 1 formed box-like and are clamped such thereto that they can be very easily lifted off in upward direction as needed, namely after the clamping mechanism is released. The mounting and dismantling of the grate plates is considerably facilitated in this way. Compared to previously known grate plates of a similar structure, the inventively formed grate plates also have the advantage that they have a long service life and, due to the uniform wear, only a slight loss of material occurs when the worn grate plate is replaced by a new one.

The subject matter of the invention is not limited to embodiments shown in the figures of the drawing. Thus, for example, the releasable fastening of the grate plates 5 can ensue with arbitrarily different clamping mechanisms such as keys, screws and the like. Further, the grate plate carriers can be arranged proceeding step-shaped or the like with the grate plates and can be employed with exactly the same advantages with different types of grate coolers.

Thus, it will be seen that there has been provided an improved grate construction which is capable of achieving the objectives above set forth and is designed so as to not only provide a reliable simplified construction but to improve the cooling operation of the grate.

I claim as my invention:

1. An improved cooling grate plate construction for cooling hot bulk material with cooling air comprising in combination:

a plurality of successive grate plates each arranged to deliver to a successive plate at a downstream delivery end and arranged for cooling conveyed hot bulk material;

a grate plate carrier having planar cover plates extending in a product conveying direction positioned in sequence and arranged each for supporting a grade plate;

means defining air passage openings through said cover plates;

means securing each grate plate to a cover plate;

recess passages in the lower surface of said grate plates in alignment with said cover plate openings with the upper surface of the cover plate forming a wall for a portion of the extent of the recess passage and for conducting air between the grate plates and the upper surfaces of the cover plates, said passages leading to upwardly facing slots in the upper surfaces of the grate plates; and individual air delivery conduits in the carrier leading to said cover plate openings of each cover plate.

2. An improved cooling grate plate construction for cooling hot bulk material with cooling air constructed in accordance with claim 1:

characterized in that partial air flow blocking elements are inserted in the cover plates projecting into the recess passages for providing partial blocking thereof.

3. An improved cooling grate plate construction for cooling hot bulk material with cooling air constructed in accordance with claim 1:

characterized in that said recess passages expand funnel-like in an upward direction.

4. An improved cooling grate plate construction for cooling hot bulk material with cooling air constructed in accordance with claim 1:

including air flow control mechanism for regulating air quantity positioned in the individual air delivery conduits.

5. An improved cooling grate plate construction for cooling hot bulk material with cooling air constructed in accordance with claim 1:

wherein said cover plates have seating recesses opposite said recess passages for the receipt of control blocking elements to restrict the size of the recess passages.

6. An improved cooling grate plate construction for cooling hot bulk material with cooling air constructed in accordance with claim 1:

including clamping means for securing said grate plates individually to said grate plate carrier.

7. An improved cooling grate plate construction for cooling hot bulk material with cooling air constructed in accordance with claim 1:

including downwardly descending floors in the upper surface of said cover plates opposite said recess passages.

8. An improved cooling grate plate construction for cooling hot bulk material with cooling air constructed in accordance with claim 1:

wherein each of said grate plates has a substantially vertical nose at its delivery end with an air exit opening in the nose portion directed in the product movement direction.

9. An improved cooling grate plate construction for cooling hot bulk material with cooling air constructed in accordance with claim 1:

wherein each successive plate butts against a preceding plate and clamping means is provided securing the plates to the carrier and holding each plate against the immediate preceding plate.

10. An improved cooling grate plate construction for cooling hot bulk material with cooling air comprising in combination:

a movable grate plate carrier for conveying hot bulk material forwardly;

a plurality of successive grate plates each arranged to deliver to a successive plate in a downstream delivery direction at a delivery end and arranged for cooling conveyed hot bulk material and having an upper surface inclined inwardly;

planar cover plates supported on the carrier with each plate supporting a grate plate and having upwardly extending air passage openings therethrough;

means securing each grate plate to a cover plate holding the grate plate downwardly against the cover plate and rearwardly against a preceding grate plate;

means defining recess passages in the lower surface of the grate plates in alignment with the openings in the cover plates and extending in the direction of product movement;

means defining upwardly opening slots leading from the recess passages opening from the upper surface of the grate plates for the passage of air through material on the upper surface of the grate plates;

a tapered outwardly flaring downstream wall for each of the openings through the upper surface of the grate plates;

an individual air delivery conduit in the carrier leading to the openings in each of the cover plates;

means for individually controlling the flow of air through said air delivery conduits; and means for delivering air to said conduits.

* * * * *